US005390853A

United States Patent [19]

Ellul

[11] Patent Number: 5,390,853

[45] Date of Patent: Feb. 21, 1995

[54] GUTTER CLEANING TOOL AND SYSTEM

[76] Inventor: Renald J. Ellul, 4015 Sashaban, Waterford, Mich. 48329

[21] Appl. No.: 50,609

[22] Filed: Apr. 22, 1993

[51] Int. Cl.[6] ..... B05B 15/06

[52] U.S. Cl. ..... 239/282; 239/531; 239/532

[58] Field of Search ..... 239/11, 280, 280.5, 239/281, 282, 531, 532; 248/690, 691, 692

[56] References Cited

U.S. PATENT DOCUMENTS

| | | | |
|---|---|---|---|
| 1,068,273 | 7/1913 | Reed | 248/692 X |
| 2,605,136 | 7/1952 | Kune et al. | 239/280.5 X |
| 2,910,711 | 11/1959 | Mizelle | 239/532 X |
| 3,023,971 | 3/1962 | Milnous | 239/532 X |
| 3,612,426 | 10/1971 | Germock, Jr. | 248/690 X |
| 4,150,793 | 4/1979 | Russo | 239/532 |
| 4,673,129 | 6/1987 | Kologiy | 239/532 |
| 5,022,586 | 6/1991 | Putnam | 239/532 X |
| 5,037,028 | 8/1991 | Evans | 239/532 X |
| 5,044,038 | 9/1991 | Matkovic | 248/692 X |

*Primary Examiner*—William Grant
*Attorney, Agent, or Firm*—Hugh E. Smith

[57] ABSTRACT

The present invention comprises a gutter cleaning tool adapted to be hooked over the edge of a gutter and to direct a stream of water therein to dislodge leaves or other debris in the gutter towards and down the downspout of the gutter. In case of jamming of such debris in the downspout, a plunger is provided for pushing such debris down the downspout. The entire system is operable from the ground level eliminating the need for ladders or the like to reach the gutters.

1 Claim, 3 Drawing Sheets

GUTTER CLEANING TOOL AND SYSTEM

BACKGROUND OF THE INVENTION

1. Field of the Invention

The present invention relates to cleaning gutters on buildings and more particularly pertains to doing so without the need of ladders.

2. Description of the Prior Art

The use of water for cleaning gutters is known in the prior art. More specifically, cleaners heretofore devised and utilized for the purpose of gutter cleaning are known to consist basically of familiar, expected and obvious structural configurations, notwithstanding the myriad of designs encompassed by the crowded prior art which have been developed for the fulfillment of countless objectives and requirements.

In this respect, the tool and system according to the present invention substantially departs from the conventional concepts and designs of the prior art, and in so doing provides an apparatus primarily developed for the purpose of dislodging debris in a gutter and flushing it into a downspout while being controlled from ground level.

Prior art devices for this purpose are included in U.S. Pat. Nos. 3,858,267; 4,238,866; 4,319,851; 4,602,460; and 4,756,043. All of these devices are awkward to use and cause extreme fatigue to the user in attempting to hold them in position and to move them in and on the gutter to be cleaned.

SUMMARY OF THE INVENTION

In view of the foregoing disadvantages inherent in the known types of gutter cleaners now present in the prior art, the present invention provides an improved gutter cleaning device and system construction wherein the same can be utilized for cleaning a gutter. As such, the general purpose of the present invention, which will be described subsequently in greater detail, is to provide a new and improved cleaner apparatus and method which has all the advantages of the prior art and none of the disadvantages.

To attain this, the present invention provides a cleaner which is removeably affixed to the gutter to be cleaned; is slidable along the lip of such gutter to facilitate cleaning the entire gutter; is adjustable to reach the gutter from the ground without the use of a ladder; and can be directed from the ground to position a stream of water as desired into and along such gutter. In case of a jam in the downspout, means are provided to help dislodge the same.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved gutter cleaner which has all the advantages of the prior art devices and none of the disadvantages.

It is another object of the present invention to provide a new and improved gutter cleaning system which may be easily and efficiently manufactured and marketed.

It is a further object of the present invention to provide a new and improved gutter cleaner which is of a durable and reliable construction.

An even further object of the present invention is to provide a new and improved gutter cleaner which is susceptible of a low cost of manufacture with regard to both materials and labor, and which accordingly is then susceptible of low prices of sale to the consuming public, thereby making such cleaners economically available to the buying public.

Still yet another object of the present invention is to provide a new and improved gutter cleaning system which provides in the apparatuses and methods of the prior art some of the advantages thereof, while simultaneously overcoming some of the disadvantages normally associated therewith.

Still another object of the present invention is to provide a new and improved gutter cleaner operable from ground level.

Yet another object of the present invention is to provide a new and improved system for cleaning a gutter.

Even still another object of the present invention is to provide a new and improved gutter cleaner which does not require the use of ladders and which is not fatiguing to the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
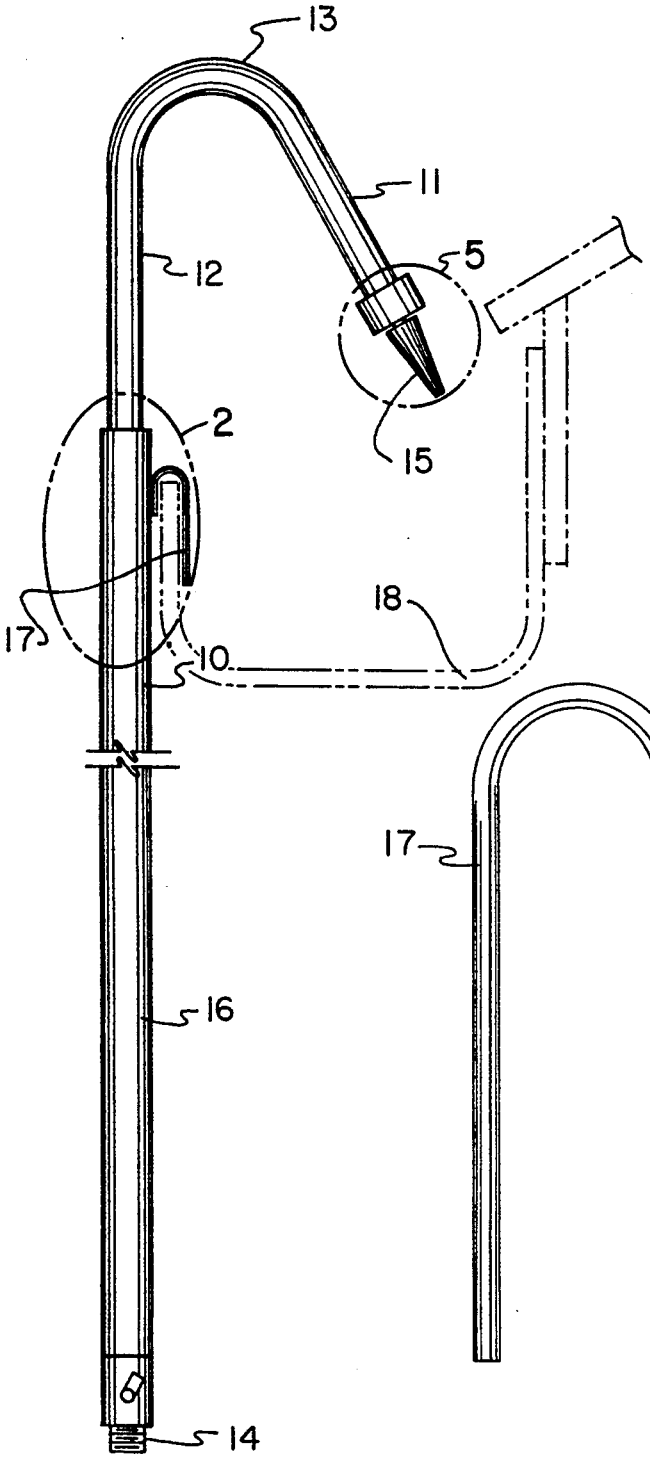
FIG. 1 is a side plan view of one form of the cleaning device of the present invention shown in relation to a gutter to be cleaned.

With reference now to the drawings, and in particular to FIG. 1 thereof, a new and improved gutter cleaner embodying the principles and concepts of the present invention and generally designated by the reference numeral 10 will be described.

More specifically, it will he noted that the cleaning device 10 as illustrated in this drawing comprises a rigid tube 11 having a straight section 12 and a curved upper portion 13. The straight section 12 terminates in its lower end with a hose connector 14 and the curved section 13 terminates in a high pressure water nozzle 15. In this modification the straight section 12 of rigid tube 11 extends downwardly through an encasing tube 16 and is rotatably mounted therein as is shown in more detail in FIG. 2. Affixed to the exterior of tube 16 and extending downwardly therefrom is a hook member 17. This hook 17 is designed to fasten in a slidable and removable fashion to the lip of a gutter to be cleaned (shown in dotted lines at 18). When rotated into engagement with the gutter 18, the hook 17 takes the weight of the assembly 10 off the user and permits the nozzle 15 to be angled within the gutter 18 by manipulation of the lower end of tube 16.

Figure 2:
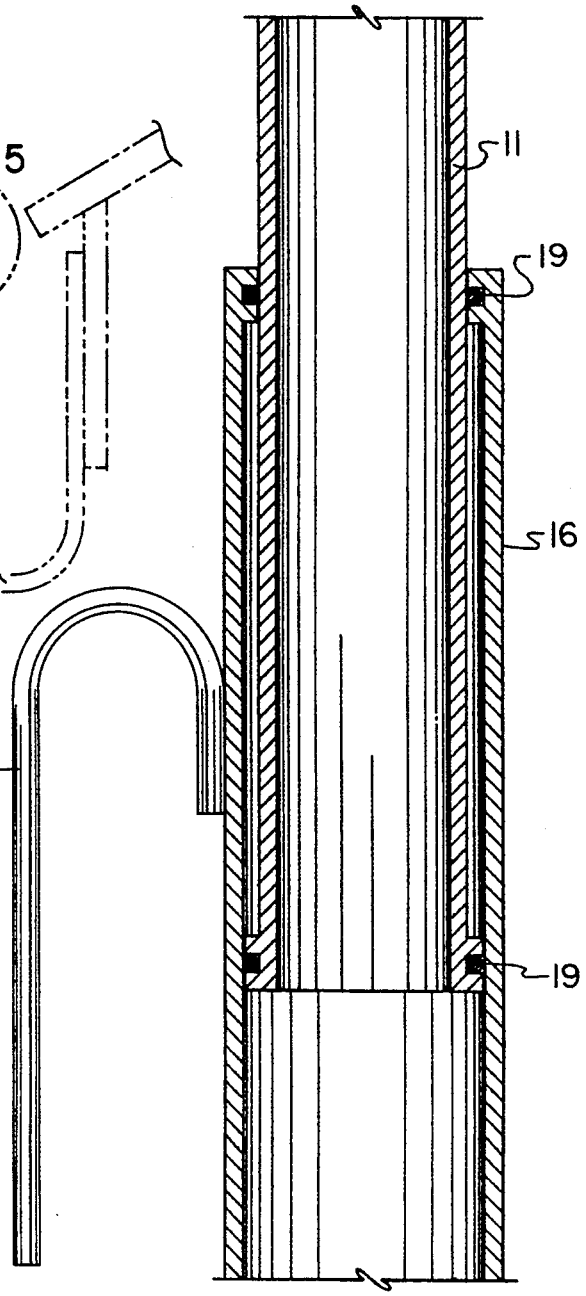
FIG. 2 is sectional view of that portion of the deice in FIG. 1 indicated generally on FIG. 1 by the numeral 2.

As shown in detail in the sectional view of FIG. 2, the internal water carrying tube 11 is rotatably mounted within external tube 16 by ball-bearing races 19. This permits the hook 17 to be rotated as desired around tube 11.

Figure 3:
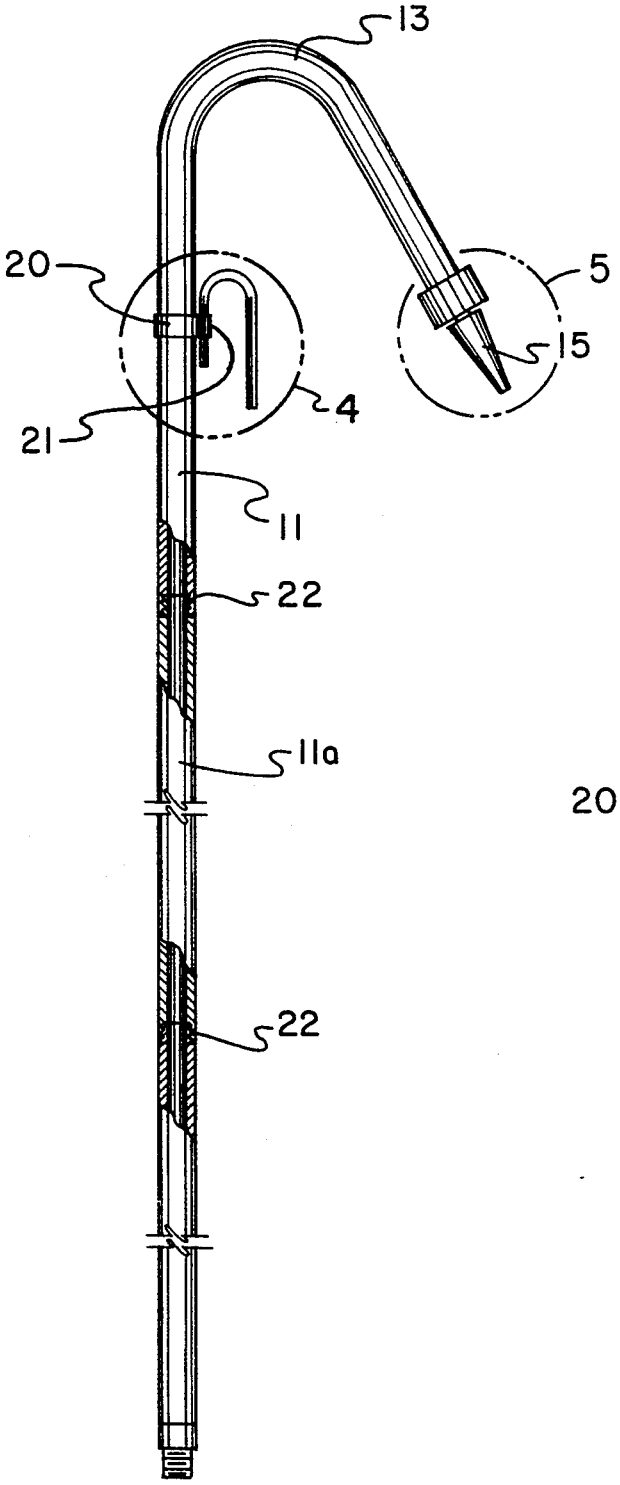
FIG. 3 is a side plan view of another form of the device of the present invention with a partial sectional view of a portion of such device.

FIG. 3 illustrates a modification wherein hook 17 is mounted directly to water-carrying tube 11 by means of an annular collar member 20 rotatable about tube 11. In this modification hook 17 is also pivotal relative to tube 11 around a pin 21 affixing said hook 17 to said annular collar member 20. This permits easier angulation of the curved portion 13 and its associated nozzle 15 to direct water from nozzle 15 along the gutter to be cleaned. Also shown in this drawing in partial section is an insert section of tube designated as 11*a*. By utilizing one or more of such tube sections 11*a* which are provided with threaded ends 22 engaging with mating threaded portions of tube 11, tube 11 may be lengthened as desired to reach gutters at, for instance, a second story elevation and still permit the water flow at the upper end 13 of tube 11 to be directed as desired.

Figure 4:
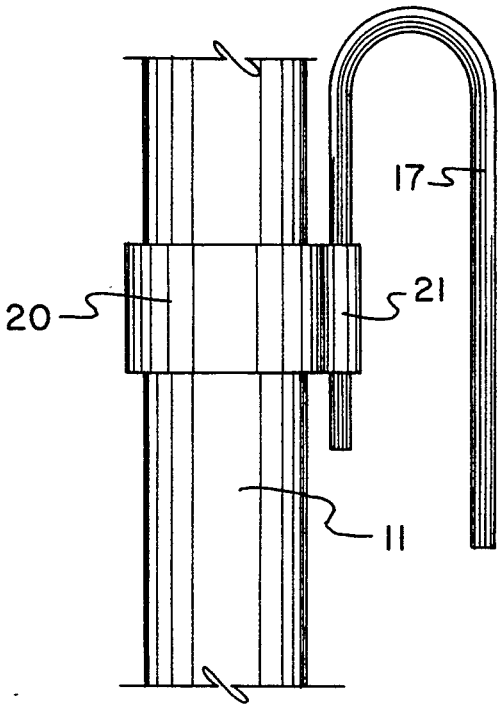
FIG. 4 is an enlarged view of that portion of FIG. 3 indicated generally on FIG. 3 by the numeral 4.

FIG. 4 is an enlarged view of the area of FIG. 3 designated by numeral 4. The annular ring or collar 20 is rotatably mounted on tube 11 and hook member 17 is secured to collar 20 by means of the pivot pin 21.

Figure 5:
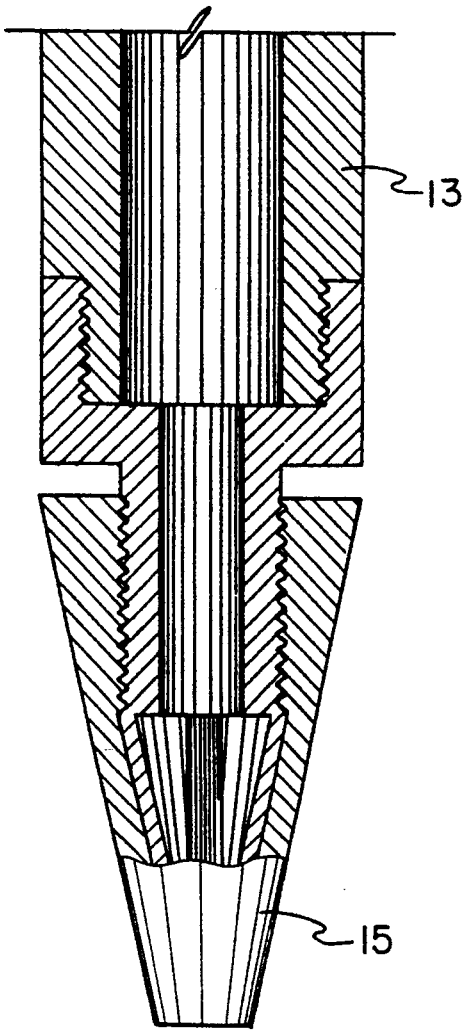
FIG. 5 is an enlarged partially sectional view of that portion of FIG. 1 generally indicated on FIG. 1 by the numeral 5.

FIG. 5 is a detailed sectional view of the upper end of the bend or curved upper section 13 of the cleaning device 10 of the present invention showing a high pressure water nozzle 15 threadably engaged therewith. Obviously, if high pressure water is not required, nozzle 15 can be removed and water can be directed straight from the tube curved portion 13.

Figure 6:
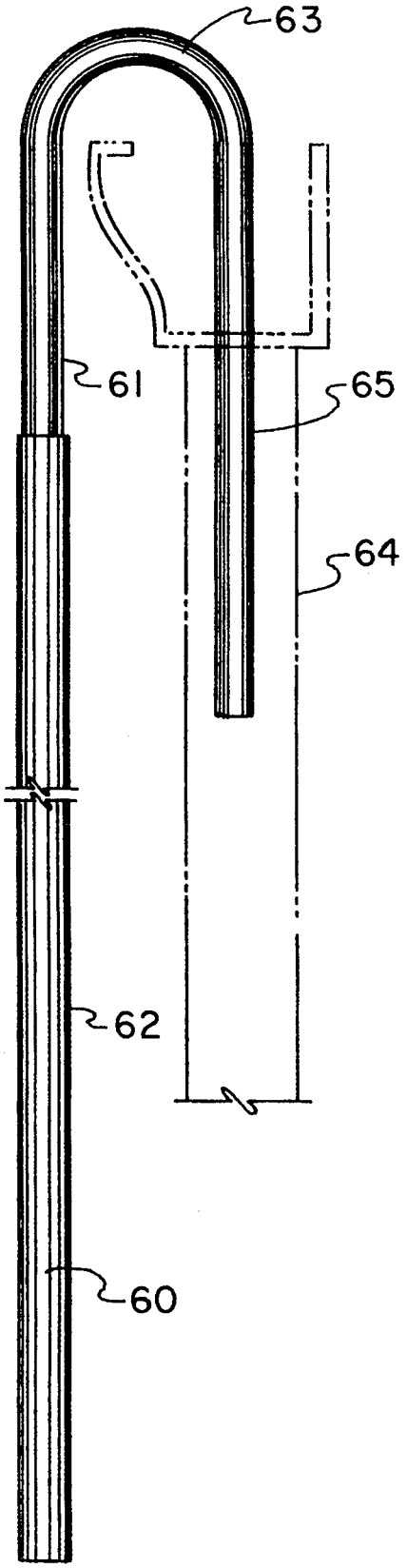
FIG. 6 is a side plan view of the downspout tamping device used in the method of the present invention.

FIG. 6 illustrates the downspout plunger or rammer 60 of the present invention. As shown, this consists of a tubular member 61 telescopically mounted within a supporting sleeve 62 so that the height of the curved upper end portion 63 of member 61 can be elevated above the downspout (shown in dotted lines as 64) and then the end portion 65 which essentially parallels the straight portion of tubular member 61 can be pulled down into the downspout 64 to dislodge any debris clogged therein.

In operation the present system permits supporting the water flushing unit of the present invention by engagement with the lip of the gutter to be cleaned; swinging the nozzle at the upper end of the cleaning device to direct water flow along the gutter and to dislodge debris therein through manipulation of the lower or ground end of such device without having to manually hold the device up in the air; and then, again without the necessity of a ladder, engaging a plunging member in the downspout of such gutter to direct pressure downwardly on any debris clogged therein.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A gutter cleaning device comprising:

a water carrying tube having a straight section and a curved upper portion, said water carrying tube having first and second ends thereof, said water carrying tube further having a first ball bearing race extending circumferentially around said first end thereof and projecting outwardly therefrom;

a substantially straight, elongated external tube having upper and lower ends with a second ball bearing race at said upper end thereof, said second ball bearing race projecting inwardly therefrom, said first end of said water carrying tube being positioned within said external tube in a telescoping relationship therewith, said ball bearing races being operable to preclude axial separation of said water carrying tube from said external tube;

a first plurality of ball bearings positioned within said first ball bearing race;

a second plurality of ball bearings positioned within said second ball bearing race;

a substantially U-shaped hook member fixedly mounted to said external tube proximal to said upper end thereof for engaging a gutter to support said cleaning device;

a high pressure water nozzle connected to said second end of said water carrying tube;

and, means for connecting said external tube to a pressurized water source.

* * * * *